US009625148B2

(12) United States Patent
Luo et al.

(10) Patent No.: US 9,625,148 B2
(45) Date of Patent: Apr. 18, 2017

(54) DEVICE FOR USE IN BURNER AND METHOD FOR MANUFACTURING THE SAME

(71) Applicants: Tianyi Luo, Zhongshan (CN); Yingzhi Wang, Zhongshan (CN)

(72) Inventors: Tianyi Luo, Zhongshan (CN); Yingzhi Wang, Zhongshan (CN)

( * ) Notice: Subject to any disclaimer, the term of this patent is extended or adjusted under 35 U.S.C. 154(b) by 620 days.

(21) Appl. No.: 14/089,844

(22) Filed: Nov. 26, 2013

(65) Prior Publication Data

US 2014/0080079 A1 Mar. 20, 2014

Related U.S. Application Data

(63) Continuation-in-part of application No. PCT/CN2012/076128, filed on May 25, 2012.

(30) Foreign Application Priority Data

May 26, 2011 (CN) ..... 2011 1 0138509
Jun. 1, 2011 (CN) ..... 2011 1 0145728

(51) Int. Cl.
*F23D 14/18* (2006.01)
*F23D 14/14* (2006.01)
*F23D 14/02* (2006.01)

(52) U.S. Cl.
CPC ..... *F23D 14/14* (2013.01); *F23D 14/02* (2013.01); *F23D 14/145* (2013.01); *F23D 2203/108* (2013.01); *F23D 2213/00* (2013.01); *F23D 2900/14125* (2013.01); *Y10T 29/49348* (2015.01)

(58) Field of Classification Search
CPC ..... F23D 14/586; F23D 14/18; F23D 2206/0063; F01N 2330/02; F01N 3/281; F01N 3/2814
USPC ..... 431/328
See application file for complete search history.

(56) References Cited

U.S. PATENT DOCUMENTS 1,372,724 A * 3/1921 Stine ..... F23D 14/586 239/552
3,438,719 A * 4/1969 Gething ..... F23D 14/10 239/552

(Continued)

FOREIGN PATENT DOCUMENTS

CN 201170553 Y * 12/2008

*Primary Examiner* — Jorge Pereiro
(74) *Attorney, Agent, or Firm* — Matthias Scholl, PC; Matthias Scholl

(57) ABSTRACT

A device for use in a burner, including a honeycomb body formed from a metal band. The metal band is laminated or coiled to yield a plurality of holes or apertures. The honeycomb body has first and second surfaces which are opposite to each other. The holes or apertures penetrate through the first surface and the second surface, and an outer boundary of the first surface and an outer boundary of the second surface are connected whereby yielding a lateral surface. A through hole is disposed on the lateral surface of the honeycomb body and penetrates inward through multiple layers of adjacent laminated or coiled metal bands, and a metal wire is disposed in the through hole; and/or, a part of the laminated or coiled metal bands on the first surface and/or the second surface are embedded, overlapped and engaged with adjacent metal bands to form an embedded member.

20 Claims, 12 Drawing Sheets

(56) References Cited

U.S. PATENT DOCUMENTS 4,290,789 A * 9/1981 Newton ..... F24F 3/1423 428/469
4,348,360 A * 9/1982 Chang ..... B01J 35/04 422/122
4,361,620 A * 11/1982 Newton ..... F24F 3/1423 148/275
4,793,136 A * 12/1988 Whittenberger ... B01D 53/9454 422/177
4,869,230 A * 9/1989 Fletcher ..... F23C 3/002 126/91 A
5,374,402 A * 12/1994 Hitachi ..... B01J 35/04 422/177
5,622,491 A * 4/1997 Van Belle ..... B01F 5/045 431/115
5,737,839 A * 4/1998 Whittenberger ..... B01J 35/04 29/890
6,187,274 B1 * 2/2001 Nilsson ..... B01J 35/04 422/177
6,288,008 B1 * 9/2001 Matsumoto ..... B01J 35/04 422/180
6,537,681 B1 * 3/2003 Swars ..... B01D 53/885 422/180
6,589,910 B1 * 7/2003 Swars ..... B01D 53/885 502/439
6,720,060 B1 * 4/2004 Swars ..... B01J 35/04 422/177
6,793,896 B1 * 9/2004 Swars ..... B01D 53/885 422/177
7,655,194 B2 * 2/2010 Muter ..... F01N 3/281 422/168
7,931,240 B2 * 4/2011 Kothera ..... B63B 1/248 244/218
8,337,762 B2 * 12/2012 Vakkilainen ..... B01D 53/865 29/890
2011/0111356 A1 * 5/2011 Claerbout ..... F23D 14/14 431/329

* cited by examiner

DEVICE FOR USE IN BURNER AND METHOD FOR MANUFACTURING THE SAME

CROSS-REFERENCE TO RELATED APPLICATIONS

This application is a continuation-in-part of International Patent Application No. PCT/CN2012/076128 with an international filing date of May 25, 2012, designating the United States, now pending, and further claims priority benefits to Chinese Patent Application No. 201110138509.9 filed May 26, 2011, and to Chinese Patent Application No. 201110145728.X filed Jun. 1, 2011. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 14781 Memorial Drive, Suite 1319, Houston, Tex. 77079.

BACKGROUND OF THE INVENTION

Field of the Invention

The invention relates a device for use in a burner, more particularly a burner applied to a premixed burner for infrared radiation heating, and to a method for manufacturing the same.

Description of the Related Art

Conventional gas appliances utilize mainly an atmospheric burner, which heats the target mainly by convection. This heating mode results in a large amount of thermal loss. In fact, the maximum thermal efficiency of the atmospheric burner does not exceed 55%. Thus, to improve the thermal efficiency in gas appliances, the existing heating mode must be modified.

Typically, as an improvement, an infrared burner can transform the ordinary physical and chemical thermal energy into infrared radiation energy. The thermal energy is transferred to the heating object in the form of infrared radiation. This heating mode effectively reduces the physical and chemical thermal losses, the thermal efficiency of the burner exceeds 68%, and the emissions of CO and $NO_X$ are far below the international discharge standard.

However, in practice, a portion of metal bands of the infrared burner is apt to protrude due to the frequent alternation between high and low temperatures, which causes the deformation and axial movement of the honeycomb body, thereby affecting the normal use of the burner.

SUMMARY OF THE INVENTION

In view of the above-described problems, it is one objective of the invention to provide a device for use in a burner free of deformation, and in use, the metal bands included therein are free of axial movement.

It is another objective of the invention to provide a method for manufacturing the device.

To achieve the above objectives, in accordance with one embodiment of the invention, there is provided a device for use in a burner, comprising a honeycomb body comprising a metal band. The metal band is laminated or coiled to yield a plurality of holes or apertures. The honeycomb body has a first surface and a second surface which are opposite to each other. The holes or apertures penetrate through the first surface and the second surface, and an outer boundary of the first surface and an outer boundary of the second surface are connected whereby yielding a lateral surface. A through hole is disposed on the lateral surface of the honeycomb body and penetrates inward through multiple layers of adjacent laminated or coiled metal bands, and a metal wire is disposed in the through hole; and/or, a part of the laminated or coiled metal bands on the first surface and/or the second surface are embedded, overlapped and engaged with adjacent metal bands to form an embedded member.

In a class of this embodiment, the holes or apertures are regular or irregular in shape, and a regular shape thereof comprises a sector, round, oval, semi-circle, triangle, or polygon.

In a class of this embodiment, a central hole having a diameter of between 2 and 300 mm is disposed in a middle of the honeycomb body to operate as an air flow channel.

In a class of this embodiment, the central hole, the lateral surface, or the both are encircled by a metal frame.

In a class of this embodiment, a groove formed by embedding the laminated or coiled metal bands is filled with a metal material, and the metal material is fixed on the laminated or coiled metal bands by welding or bonding.

In a class of this embodiment, the embedded member is formed and fixed by self-melting and welding of the laminated or coiled metal bands, or fixed by bonding.

In a class of this embodiment, the embedded member is formed on the laminated or coiled metal bands close to an inner or outer boundary of the honeycomb body.

In a class of this embodiment, the embedded member intersects with the whole of the laminated or coiled metal bands of the honeycomb body.

In a class of this embodiment, the metal band employs a corrugated metal band, or an integrated metal band comprising a corrugated metal band and a smooth metal band.

In a class of this embodiment, the metal band employs an integrated metal band comprising two corrugated metal bands, and the holes or apertures are formed between the two corrugated metal bands.

In a class of this embodiment, the first surface and/or the second surface of the honeycomb body is covered with at least one layer of metal mesh or metal fiber structure, the metal fiber structure is breathable and presents in the form of fiber mesh, fiber felt, woven mesh, or fiber paper, and a contact point between the honeycomb body and the metal mesh/the metal fiber structure is fixed by welding or bonding.

In a class of this embodiment, a thickness between the first surface and the second surface is between 1 and 300 mm.

In accordance with another embodiment of the invention, there provided is a method for manufacturing the device for use in a burner. The method comprises the following steps:

a) preparing the metal band;

b) laminating or coiling the metal band to form the honeycomb body comprising the plurality of holes or apertures; and c) disposing the through hole on the lateral surface of the honeycomb body, allowing the through hole to penetrate inward through multiple layers of adjacent laminated or coiled metal bands, and disposing the metal wire in the through hole; and/or, embedding a part of the laminated or coiled metal bands in the first surface and/or the second surface, and overlapping and engaging the embedded metal bands with adjacent metal bands to form the embedded member.

In a class of this embodiment, the method further comprises covering the first surface and/or the second surface of the honeycomb body with at least one layer of metal mesh or metal fiber structure, and welding or bonding a contact point between the honeycomb body and the metal mesh/the metal fiber structure. The metal fiber structure is breathable and presents in the form of fiber mesh, fiber felt, woven mesh, or fiber paper.

In a class of this embodiment, the method further comprises disposing a central hole having a diameter of between 2 and 300 mm in a middle of the honeycomb body to operate as an air flow channel.

In a class of this embodiment, the method further comprises disposing metal frames to encircle the central hole and the lateral surface, respectively.

In a class of this embodiment, the method further comprises filling a groove formed by embedding the metal bands with a metal material, and fixing the metal material on the laminated or coiled metal bands by welding or bonding.

In a class of this embodiment, the method further comprises fixing the embedded metal bands by self-melting and welding of the embedded metal bands, or by bonding the embedded metal bands.

In a class of this embodiment, step a) is achieved according to one of the following three steps:

1) preparing a corrugated metal band;
2) preparing an integrated metal band comprising a corrugated metal band and a smooth metal band; or
3) preparing an integrated metal band comprising two corrugated metal bands, the holes or apertures being formed between the two corrugated metal bands.

In a class of this embodiment, the corrugated metal band prepared in step 1) is in the form of waveform including but not limited to sinusoidal waveform, sawtooth waveform, U-shaped waveform, or rectangular waveform.

The first surface and the second surface in the invention refer to a gas inlet surface and a gas outlet surface, respectively.

Advantages of the invention are summarized as below. The honeycomb body is formed by laminating or coiling the metal band, and the honeycomb body comprises the through hole and the metal wire disposed in the through hole, or the embedded member disposed on the first and/or second surface. Thus, the manufacturing process of the device for use in a burner is simple; the resulting device has low production cost, and can prevent the deformation and axial movement of the metal bands due to the frequent alternation between high temperature and low temperature.

DETAILED DESCRIPTION OF THE EMBODIMENTS

For further illustrating the invention, experiments detailing a device for use in a burner and a method for manufacturing the same are described below. It should be noted that the following examples are intended to describe and not to limit the invention.

Detailed description of the invention is given below in conjunction with accompanying FIGS. 1-12.

Example 1

Figure 1:
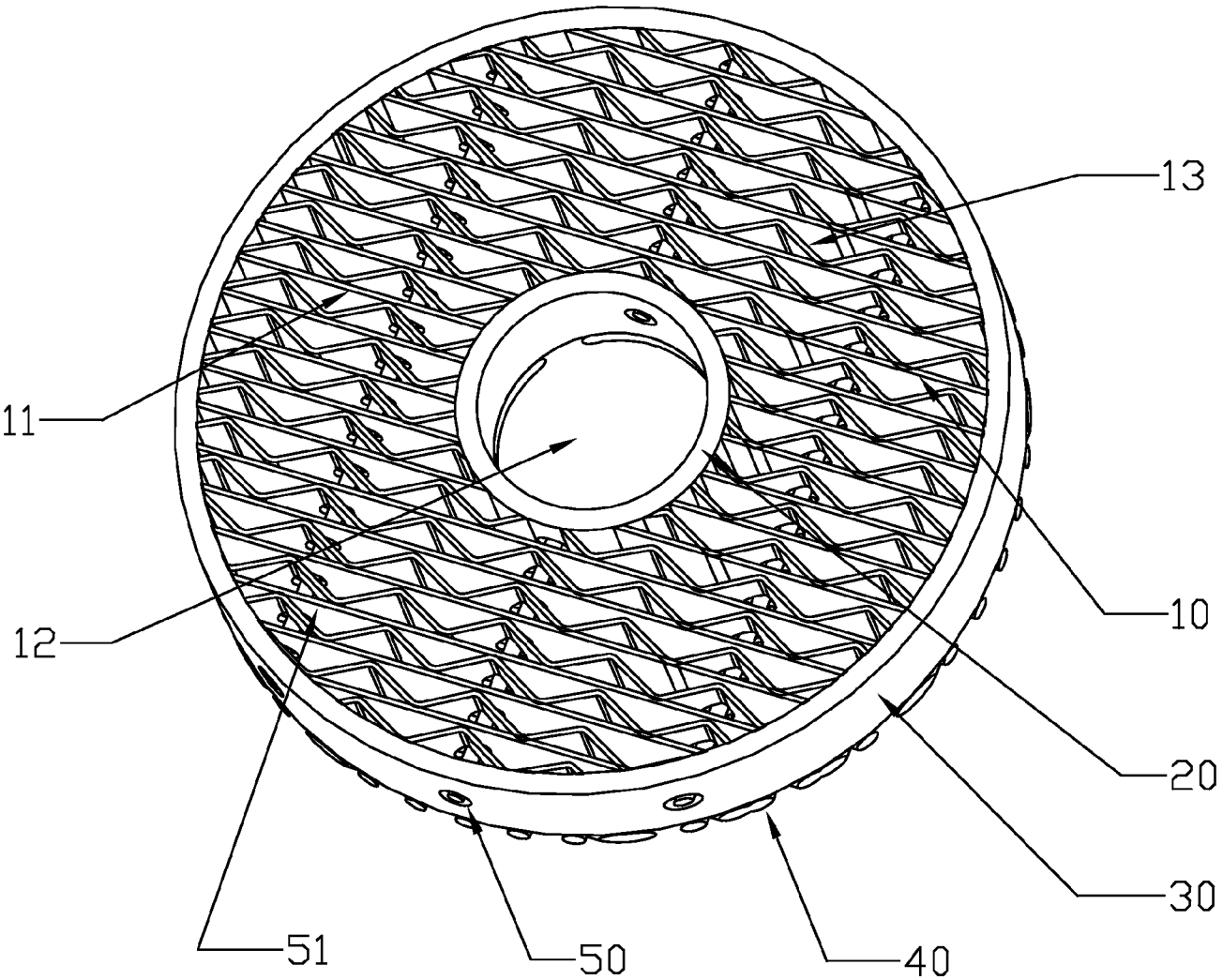
FIG. 1 is a stereogram of a device for use in a burner in accordance with one embodiment of the invention.
Figure 2:
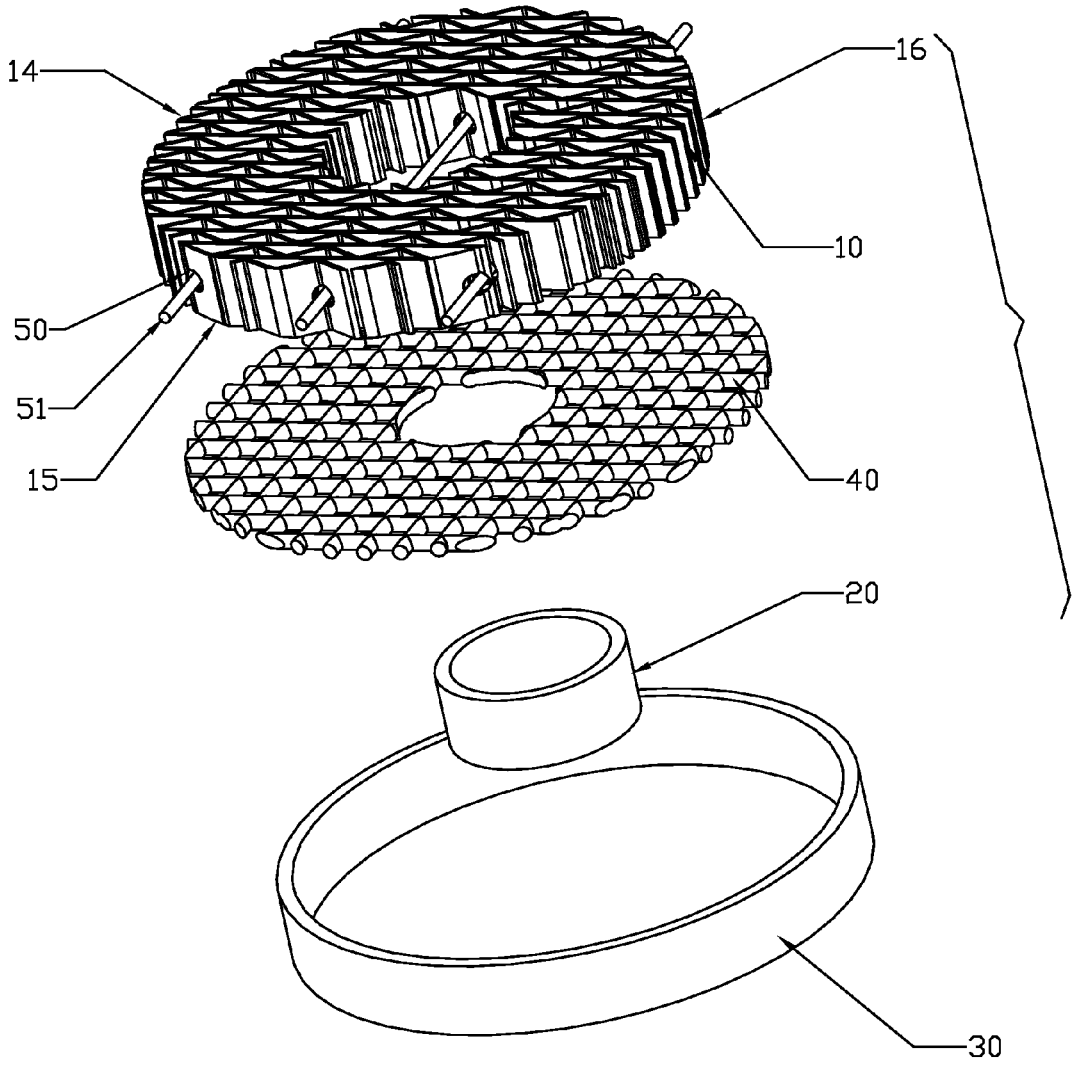
FIG. 2 is an exploded view of a device for use in a burner as shown in FIG. 1.

As shown in FIGS. 1-2, a device applied to a gas appliance, comprises a honeycomb body 10. The honeycomb body 10 comprises a metal band and a plurality of holes or apertures which are formed by laminating or coiling the metal band. The honeycomb body 10 has a first surface 14 and a second surface 15 which are opposite to each other, and an outer boundary of the first surface and an outer boundary of the second surface are connected whereby yield a lateral surface 16. A through hole 50 is disposed on the lateral surface of the honeycomb body and penetrates inward through multiple layers of adjacent laminated or coiled metal bands, and a metal wire 51 is disposed in the through hole 50 for fixing the metal bands.

In this example, the through hole 50 and the metal wire 51 disposed in the through hole 50 constitute a special fixed structure. Conventional infrared honeycomb body is apt to expand and deform due to the frequent alternation between high and low temperatures, which causes the deformation and axial movement of the honeycomb body. The arrangement of the special fixed structure can effectively prevent the deformation and axial movement of the laminated or coiled metal bands of the honeycomb body.

As an improvement, the holes or apertures are regular or irregular in shape, and a regular shape thereof comprises a sector, round, oval, semi-circle, triangle, polygon. In contrast to elongated apertures, the holes having the above shapes have better combustion efficiency.

As an improvement, a central hole 12 having a diameter of between 2 and 300 mm is disposed in the middle of the honeycomb body 10 to operate as an air flow channel. The air flow channel allows the fuel gas to mix with the air again, thereby ensuring a complete combustion.

As an improvement, to enhance the overall structural strength of the honeycomb body, the central hole 12, the lateral surface 16, or the both are encircled by a metal frame 20, or 30 whereby fixing the honeycomb body.

As an improvement, to ensure the fixation of the metal wire 51, preferably, at least one end of the metal wire 51 is fixed on the wire band or the metal frame 20, or 30.

It should be noted that although the honeycomb body 10 is formed by laminating the metal band, it is not limited to this, the honeycomb can also be formed using other methods, for example, by coiling the metal band.

Example 2

Figure 3:
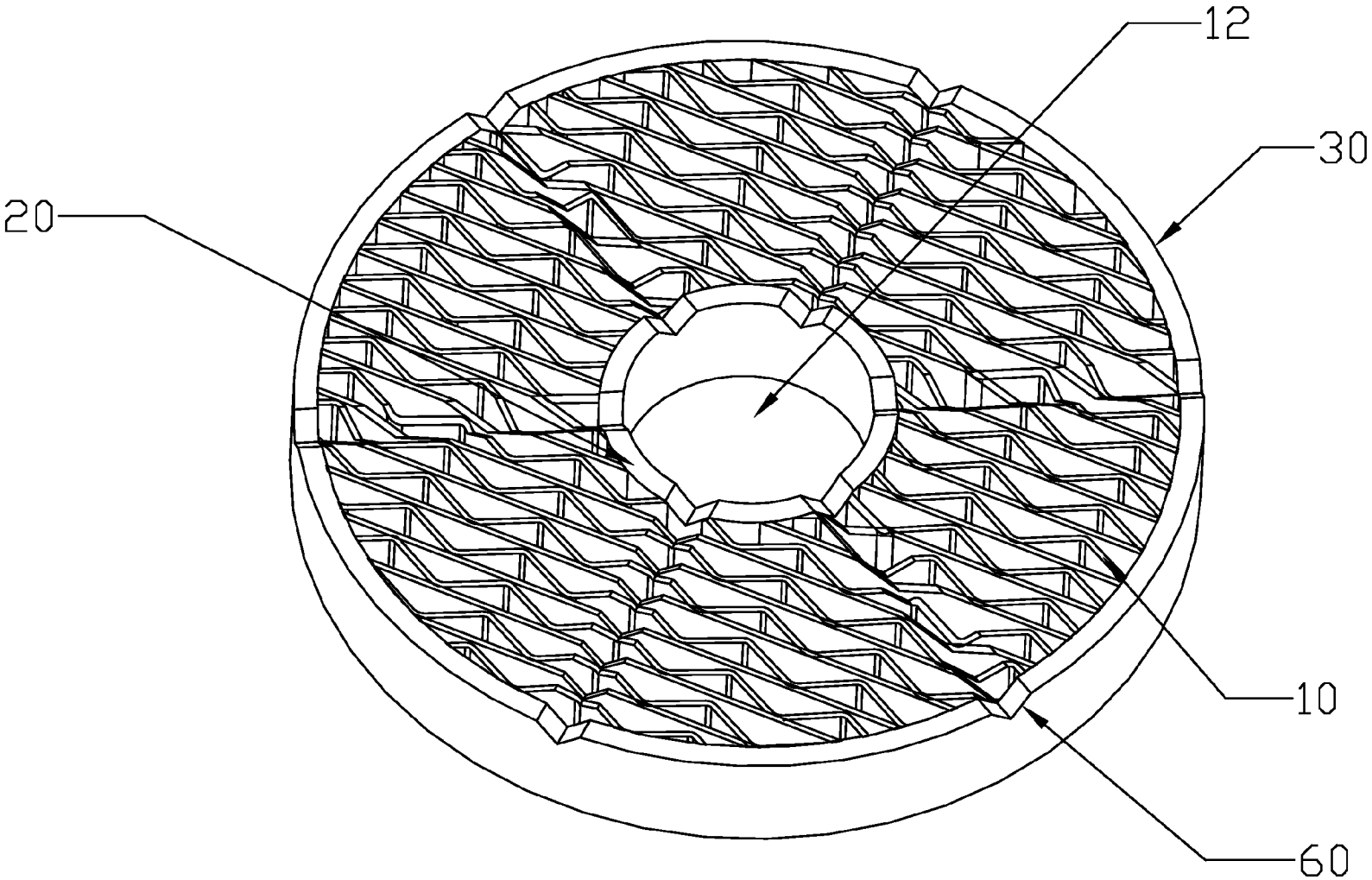
FIG. 3 is a stereogram of a device for use in a burner in accordance with another embodiment of the invention.
Figure 4:
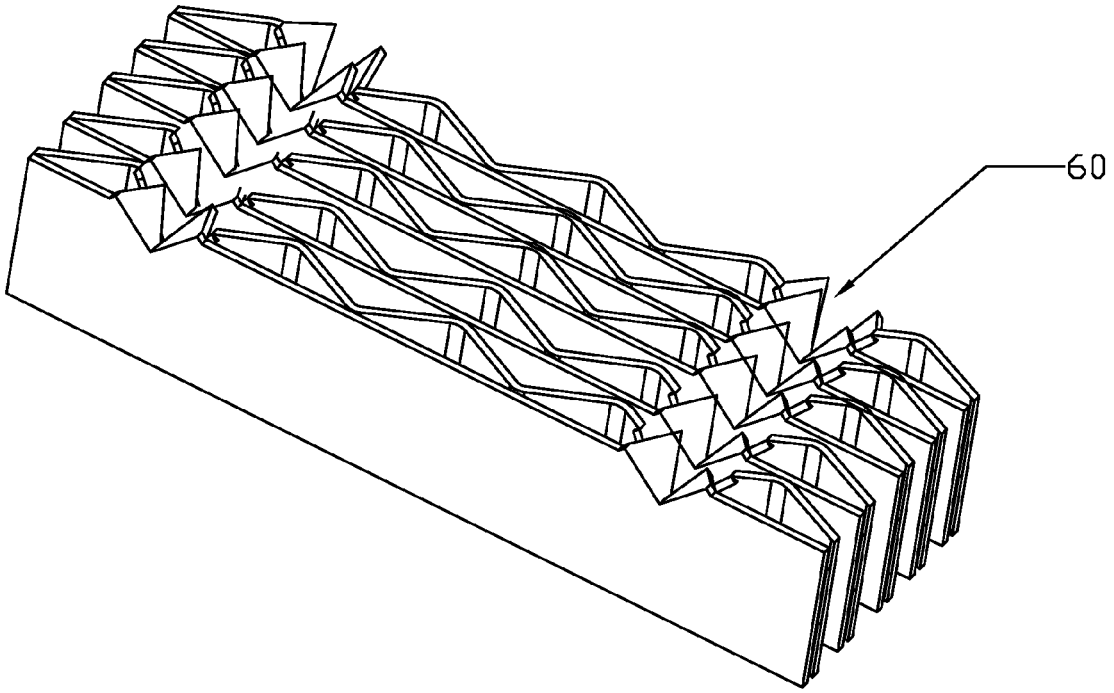
FIG. 4 is a local enlarged view of an embedded member as shown in FIG. 3.

As shown in FIGS. 3-4, a device applied to a gas appliance, comprises a honeycomb body 10. The honeycomb body 10 comprises a metal band and a plurality of holes or apertures which are formed by laminating or coiling the metal band. The honeycomb body 10 has a first surface 14 and a second surface 15 which are opposite to each other, and an outer boundary of the first surface and an outer boundary of the second surface are connected whereby yielding a lateral surface 16. A part of the metal bands on the first surface and/or the second surface are embedded, overlapped and engaged with adjacent metal bands to form an embedded member 60.

The embedded member 60 arranged on part of the first surface and/or the second surface can effectively prevent the expansion and deformation due to the frequent alternation between high and low temperatures, thereby preventing the deformation and axial movement of the laminated or coiled metal bands of the honeycomb body. Additionally, in contrast to the device in Example 1, the device in this example has a simple manufacturing process, thereby saving the production costs.

As described in Example 1, although the honeycomb 10 is formed by laminating the metal band, it is not limited to this, and the honeycomb can also be formed using other methods, for example, by coiling the metal band.

Figure 7:
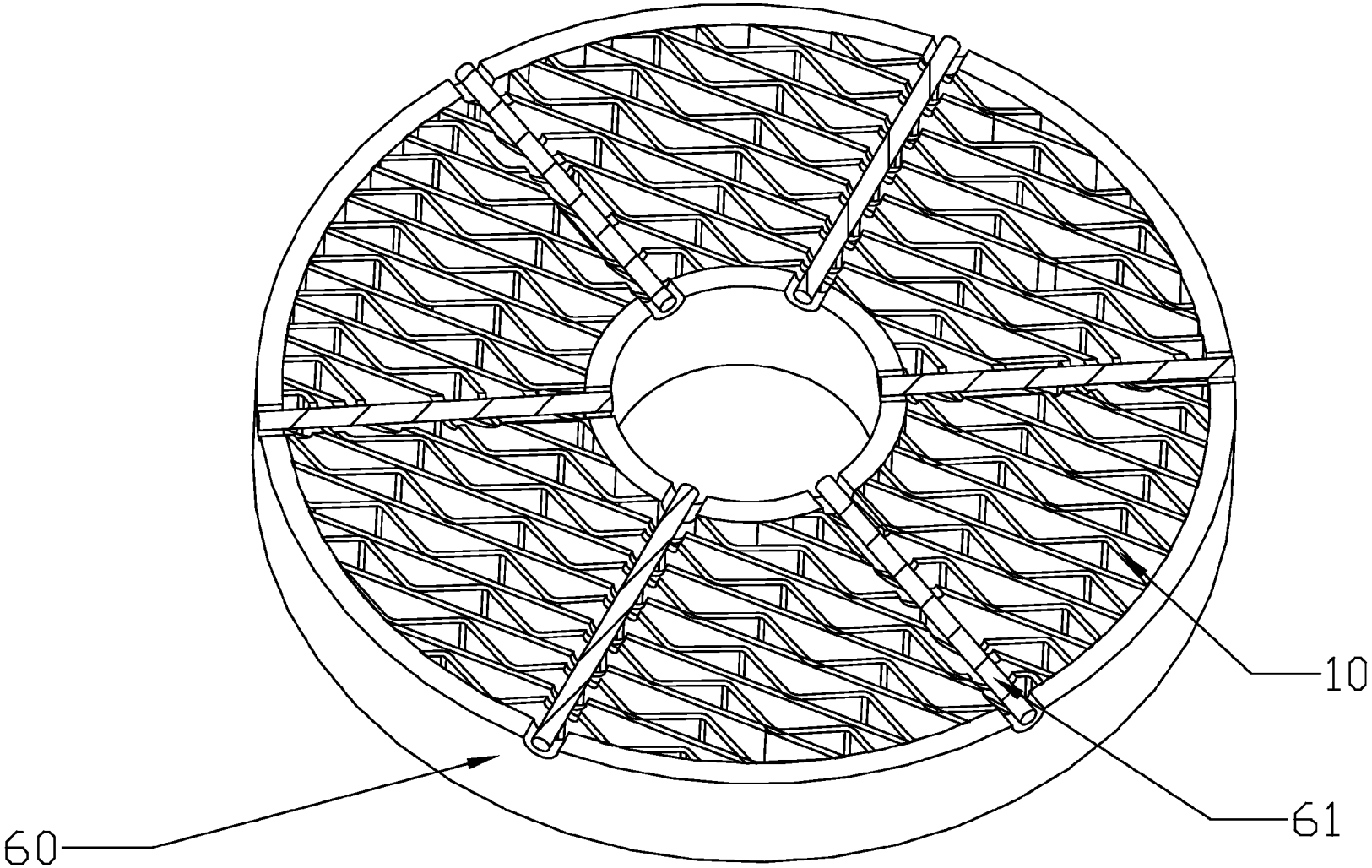
FIG. 7 is a stereogram of a device for use in a burner comprising an embedded member as shown in FIG. 2, where the embedded member is filled with a metal wire for welding and bonding.

To ensure the fixation of the embedded member, as shown in FIG. 7, a groove formed by embedding the laminated or coiled metal bands is filled with a metal material 61, and the metal material is fixed on the metal bands by welding or bonding.

Preferably, the embedded member is formed on some of the metal bands close to the edge of the honeycomb body. When the embedded member is disposed where the protrusion is most likely to occur, fewer embedded members can achieve the deformation resistance effect, thus simplifying the process.

Preferably, the embedded member intersects with the whole of the laminated or coiled metal bands of the honeycomb body. Such an arrangement of the embedded member simplifies the manufacturing process of the device.

Preferably, the embedded member is Y-shaped, with an outward opening. The Y-shaped embedded member can prevent the congestion thereof in the center of the honeycomb body.

Figure 8:
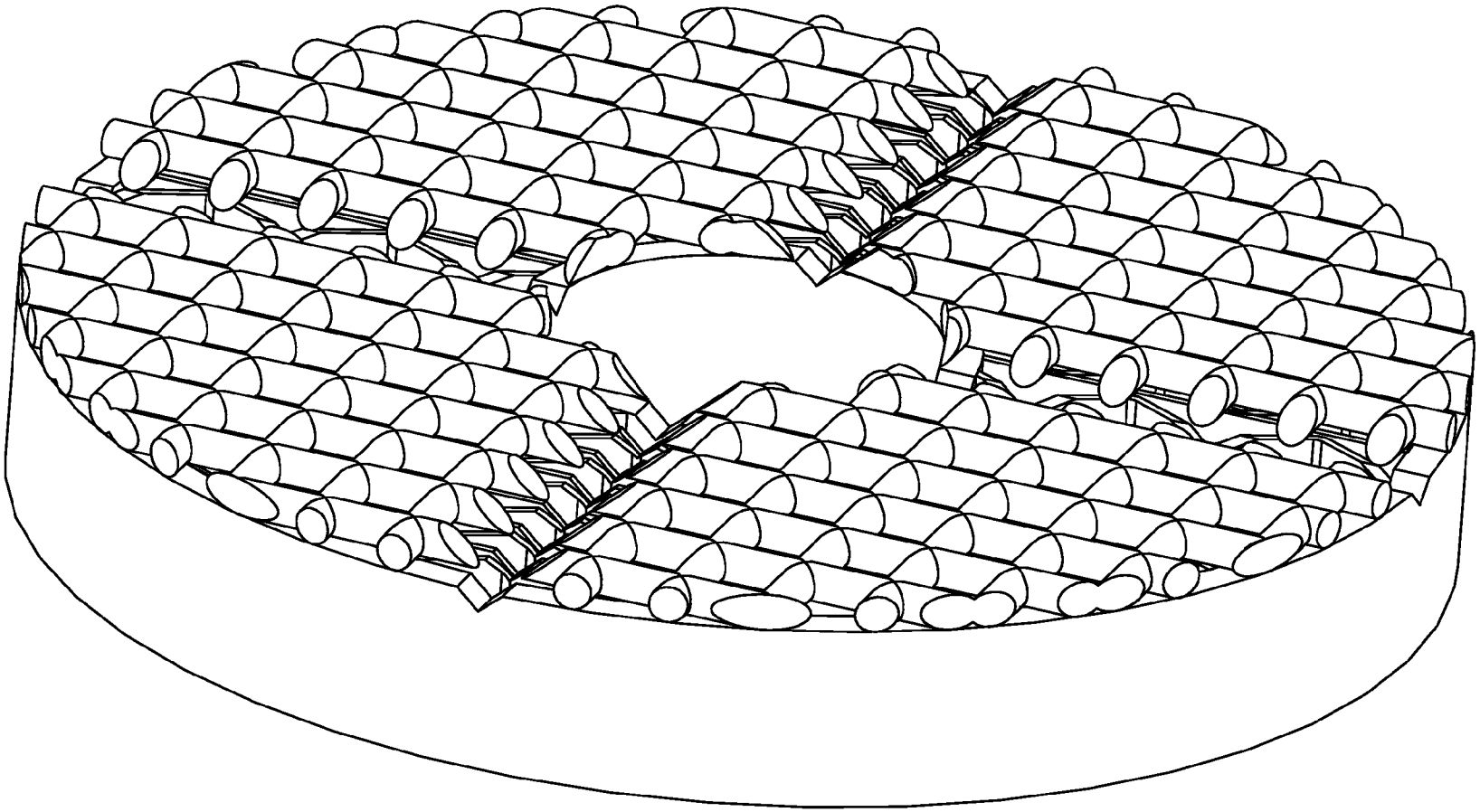
FIG. 8 is a stereogram of a device for use in a burner comprising an embedded member as shown in FIG. 2, where the embedded member is fixed by self-melting and welding or by bonding.

Preferably, as shown in FIG. 8, the embedded member 60 is formed and fixed by self-melting and welding of the metal bands, or fixed by bonding.

Preferably, the embedded member 60 can be disposed on the first surface and/or the second surface. If the embedded member 60 is disposed on the first surface, upon combustion, the device can display patterns that cannot be displayed during nonuse.

To ensure a complete combustion and the overall structural strength of the honeycomb 10, a central hole 12 having a diameter of between 2 and 300 mm is disposed in the middle of the honeycomb body 10 to operate as an air flow channel, and the central hole 12, the lateral surface 16, or the both are encircled by a metal frame 20, 30.

Figure 5:
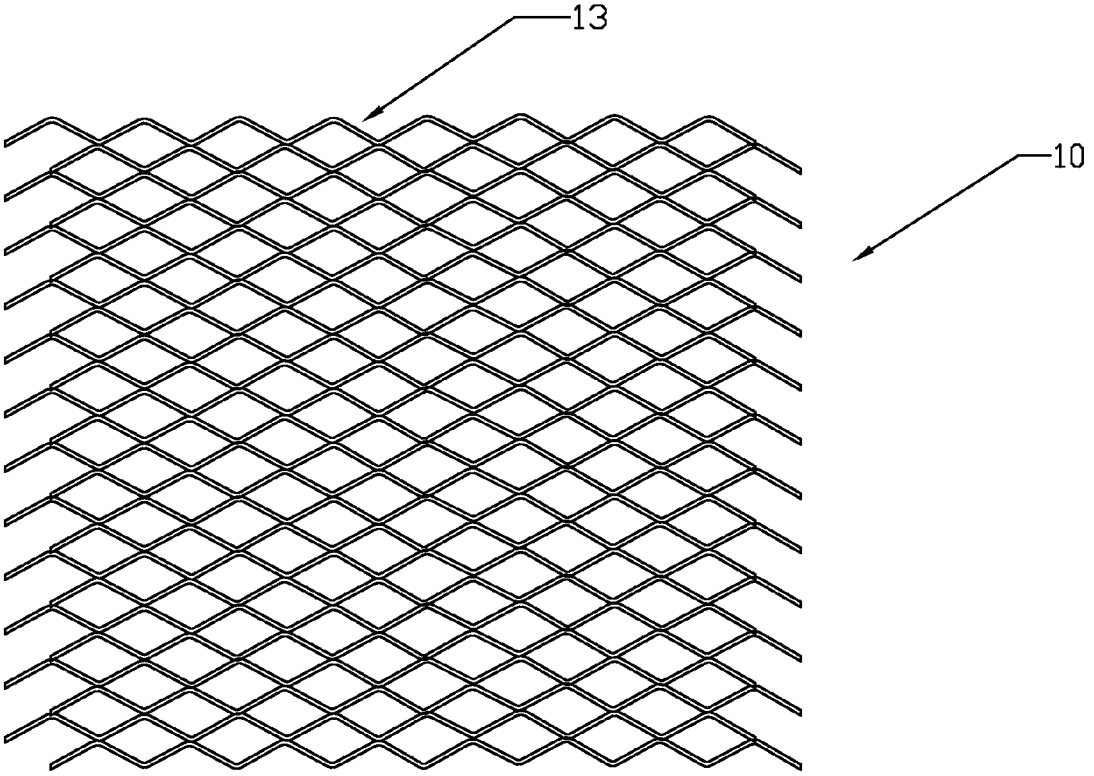
FIG. 5 is a plan view of a honeycomb body in accordance with one embodiment of the invention, where the honeycomb body is formed by laminating corrugated metal bands.
Figure 6:
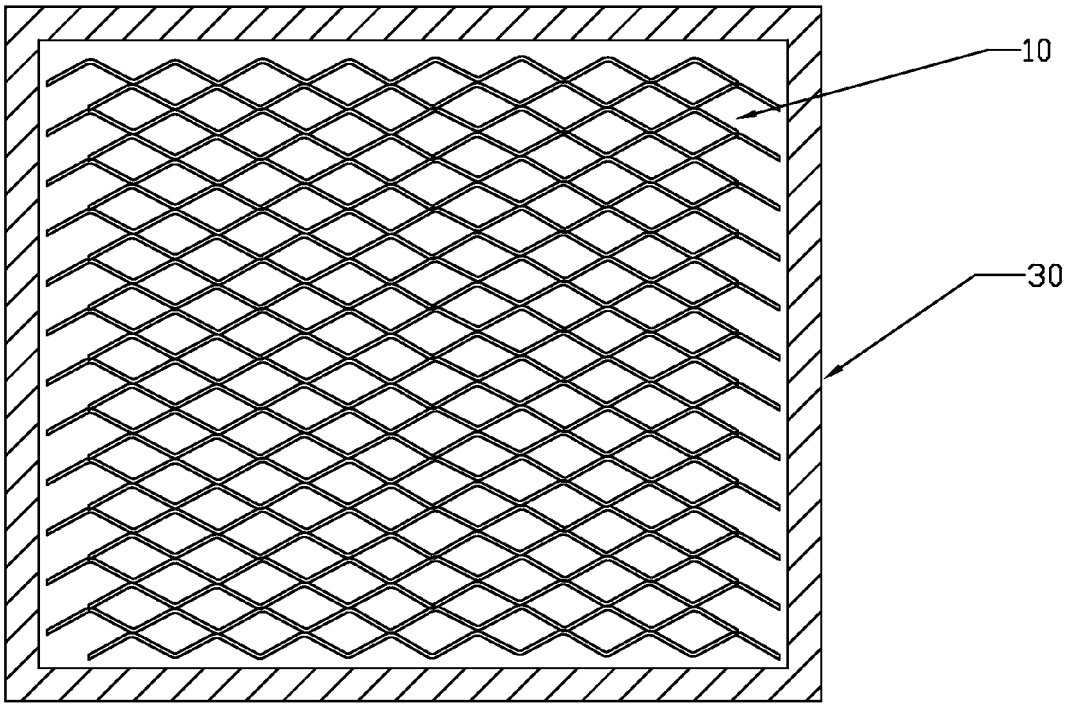
FIG. 6 is a plan view of a honeycomb body as shown in FIG. 5 which comprises a lateral surface encircled by a metal frame.

Preferably, the metal band employs a corrugated metal band 13, or an integrated metal band comprising a corrugated metal band 13 and a smooth metal band 11. Thus, the holes or apertures of the resulting honeycomb are regular in shapes, the manufacturing process is simple, and the combustion is complete and uniform. FIG. 5 shows the honeycomb body formed by laminating the corrugated metal bands 13. FIG. 6 shows the honeycomb body comprising the metal frame.

Preferably, the first surface 14 and/or the second surface 15 of the honeycomb body 10 is covered with at least one layer of metal mesh 40, and a contact point between the honeycomb body and the metal mesh is fixed by welding or bonding. The welding or bonding of the honeycomb body 10 and the metal mesh 40 enhances the strength of the device, prevents the deformation and axial movement of the metal bands of the honeycomb body due to the frequent alternation between high and low temperatures, and provides a uniform air flow whereby avoiding backfire.

Preferably, metal wires for forming the metal mesh have a diameter of between 0.01 and 10 mm, and the meshes of the metal mesh are between 2 and 500 per square inch.

Preferably, the metal mesh is formed by coiling and interweaving fine metal fibers irregularly.

Preferably, the honeycomb body 10 has a thickness of between 1 and 300 mm. Particularly, when the honeycomb body 10 is applied to a boiler or a large gas appliance, the thickness can reach 300 mm.

Preferably, the metal band constituting the honeycomb body 10 has a thickness of between 0.01 and 2 mm.

Preferably, the honeycomb body 10 has an opening percentage of between 10 and 95%.

Preferably, the honeycomb body 10 is made of iron-chromium alloy, nickel-chromium alloy, or titanium alloy.

Preferably, the holes or apertures are regular or irregular in shape, and a regular shape thereof comprises a sector, round, oval, semi-circle, triangle, polygon.

Optionally, to obtain the device having better combustion and fixation characteristics, in practice, Examples 1 and 2 can be combined.

Example 3

A method for manufacturing the device for use in a burner as described in Example 1, comprises the following steps:

a) preparing the metal band;

b) laminating or coiling the metal band to form the honeycomb body comprising the plurality of holes or apertures; and c) disposing the through hole on the lateral surface 16 of the honeycomb body, allowing the through hole to penetrate inward through multiple layers of adjacent laminated or coiled metal bands, and disposing the metal wire in the through hole for fixing the laminated or coiled metal bands.

In contrast to an integrated honeycomb, the present honeycomb body formed by laminating or coiling the metal band has a much simple manufacturing process, low manufacturing costs, and high opening percentage.

Figure 11:
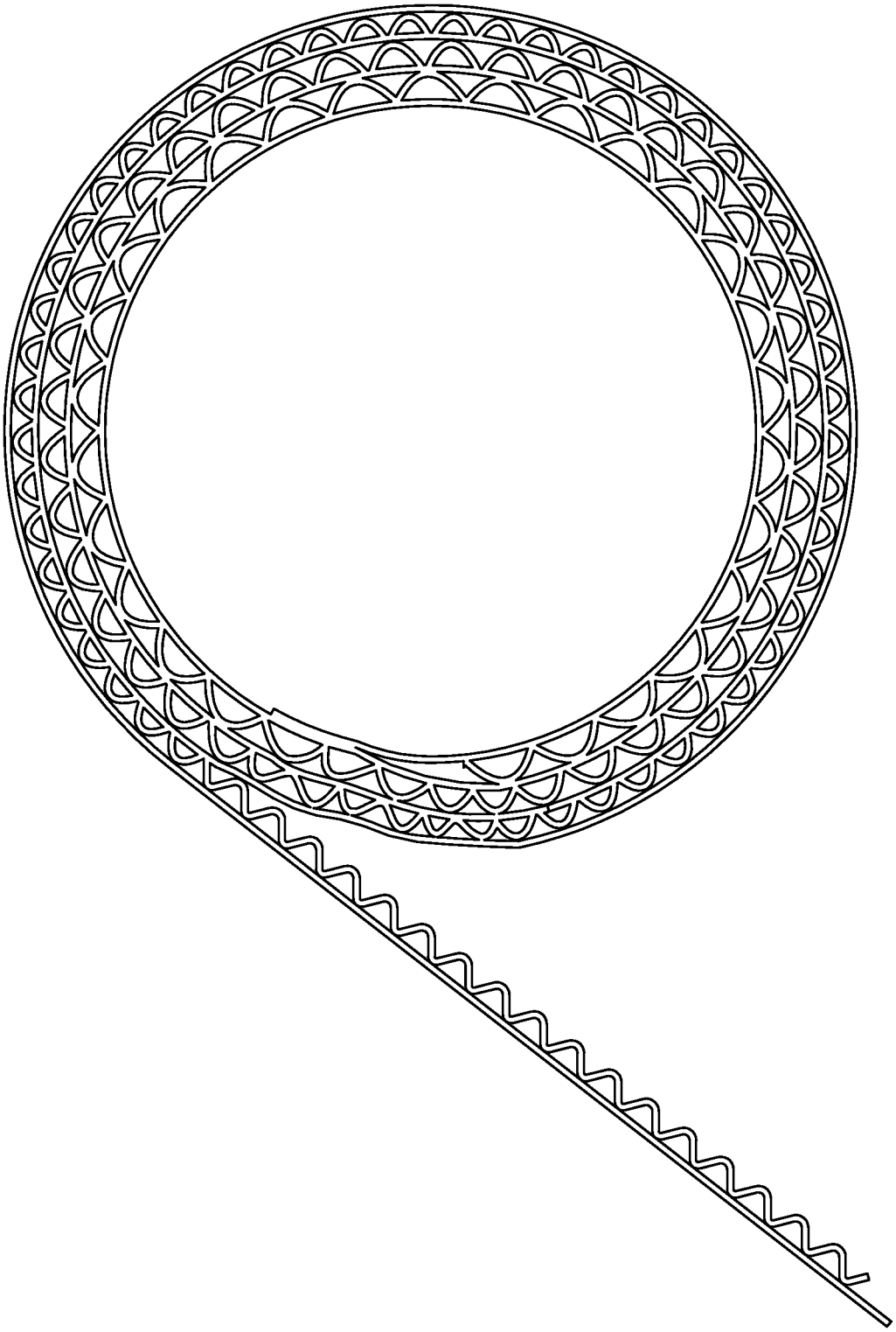
FIG. 11 shows a coil method to prepare a honeycomb body comprising a central hole.
Figure 12:
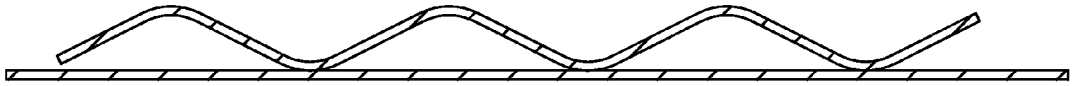
FIG. 12 shows a method to prepare an integrated metal band comprising a corrugated metal band and a smooth metal band.

Preferably, as shown in FIG. 11, upon coiling the metal band to prepare the honeycomb body, a central hole having a diameter of between 2 and 300 mm is disposed in the middle of the honeycomb body to operate as an air flow channel.

Preferably, after the honeycomb body is prepared, a metal frame is disposed to encircle the central hole and the lateral surface 16 whereby fixing the honeycomb body.

Preferably, after the metal frame is disposed, at least one end of the metal wire is fixed on the wire band or the metal frame.

Figure 9:
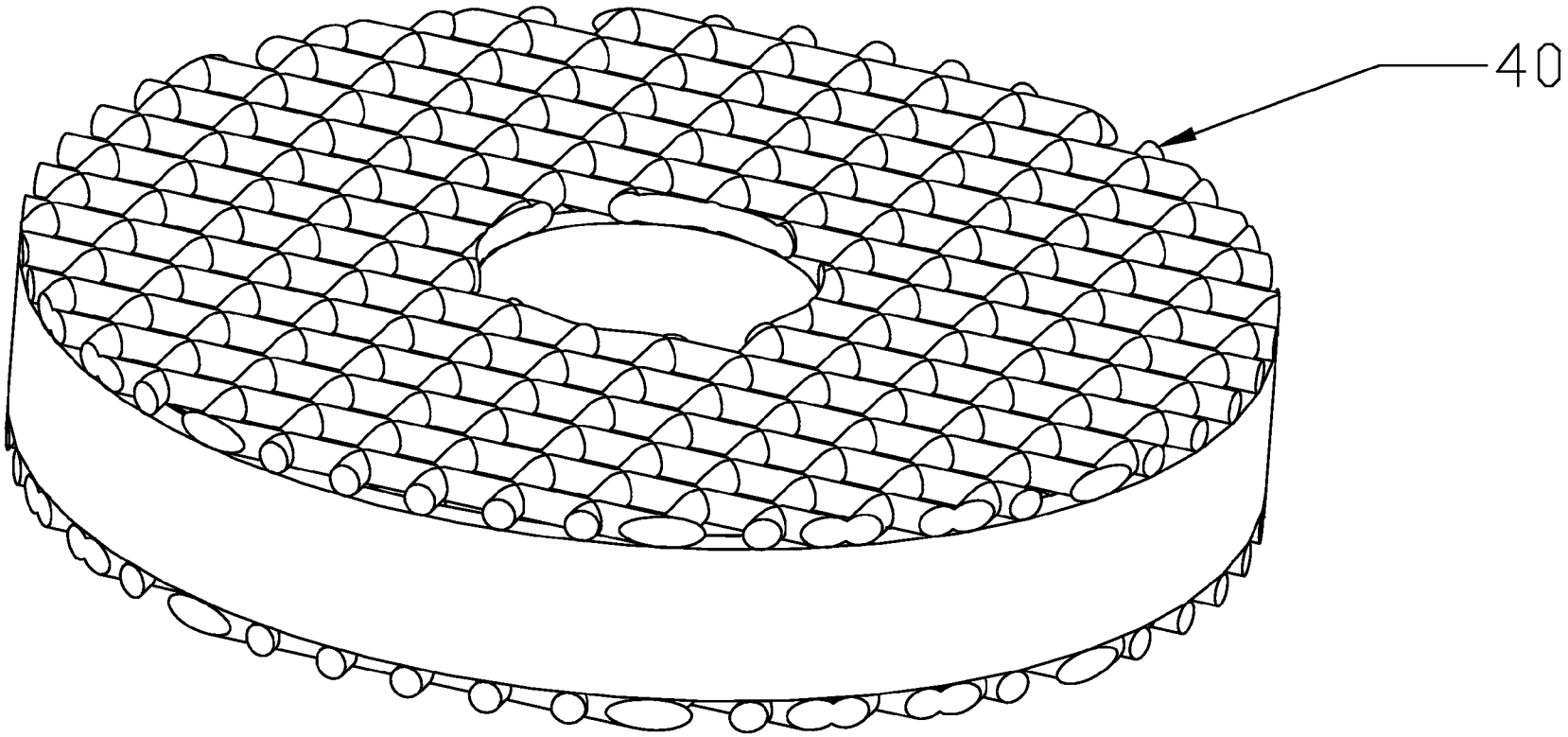
FIG. 9 is a stereogram of a honeycomb body covered with metal meshes on both sides.
Figure 10:
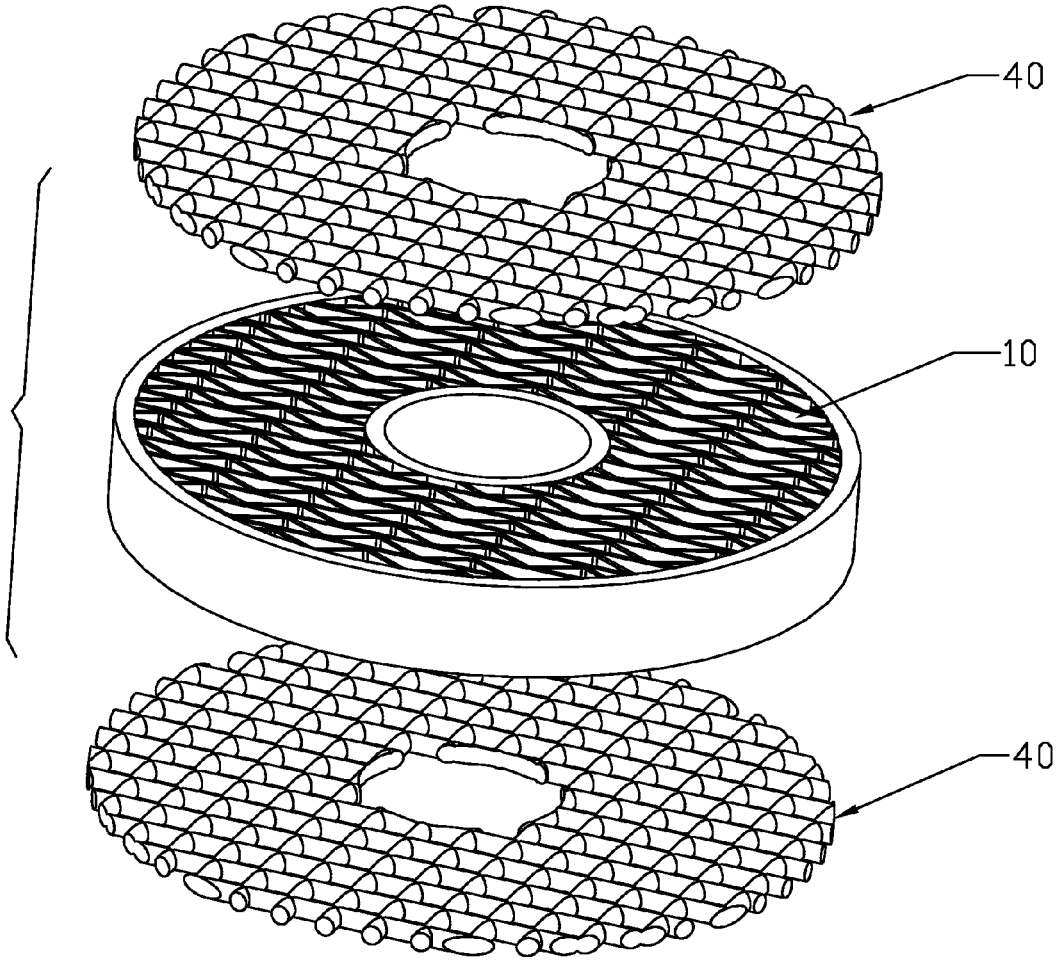
FIG. 10 is an exploded view of a honeycomb body covered with metal meshes on both sides.

Preferably, as shown in FIGS. 9-10, the first surface and/or the second surface of the honeycomb body is covered with at least one layer of metal mesh, or the first surface and/or the second surface of the honeycomb body is covered with at least one layer of metal fiber structure, the metal fiber structure is breathable and presents in the form of fiber mesh, fiber felt, woven mesh, or fiber paper, and a contact point thereof is fixed by welding or bonding.

Example 4

A method for manufacturing the device for use in a burner as described in Example 2, comprises the following steps:

a) preparing the metal band;

b) laminating or coiling the metal band to form the honeycomb body comprising the plurality of holes or apertures; and c) embedding a part of the laminated or coiled metal bands in the first surface and/or the second surface, and overlapping and engaging the embedded metal bands with adjacent metal bands to form the embedded member.

As an improvement, the method further comprises filling a groove formed by embedding the laminated or coiled metal bands with a metal material, and fixing the metal material on the laminated or coiled metal bands by welding or bonding, whereby enhancing the strength of the metal device, and preventing the deformation and axial movement of the laminated or coiled metal bands of the honeycomb body due to the frequent alternation between high and low temperatures.

As an improvement, the method further comprises fixing the embedded metal bands by self-melting and welding or bonding of the embedded metal bands, whereby achieving the same welding or bonding effects as the metal filling material and saving the material cost.

Preferably, upon coiling the metal band to prepare the honeycomb body, the method further comprises disposing a central hole having a diameter of between 2 and 300 mm in the middle of the honeycomb body to operate as an air flow channel.

Preferably, after the honeycomb body is prepared, the method further comprises disposing metal frames to encircle the central hole and the lateral surface 16, respectively, for fixing the honeycomb body.

Preferably, as shown in FIGS. 9-10, before or after the embedded member is formed, the first surface 14 and/or the second surface 15 of the honeycomb body is covered with at least one layer of metal mesh, or the first surface and/or the second surface of the honeycomb body is covered with at least one layer of metal fiber structure, the metal fiber structure is breathable and presents in the form of fiber mesh, fiber felt, woven mesh, or fiber paper, and a contact point thereof is fixed by welding or bonding. The welding or bonding of the honeycomb body and the metal mesh or metal fiber structure can effectively enhance the strength of the device and prevent the detachment of the metal mesh or metal fiber structure.

Optionally, to manufacture the device having better combustion and fixation characteristics, in practice, Examples 3 and 4 can be combined.

In Examples 3 and 4, step a) is achieved according to one of the following three steps:

1) preparing a corrugated metal band;

2) preparing an integrated metal band comprising a corrugated metal band and a smooth metal band; or 3) preparing an integrated metal band comprising two corrugated metal bands, the holes or apertures being formed between the two corrugated metal bands.

Preferably, the corrugated metal band prepared in step 1) is in the form of waveform including but not limited to sinusoidal waveform, sawtooth waveform, U-shaped waveform, or rectangular waveform. The metal band having the above waveforms can be laminated or coiled to form holes or apertures having better combustion characteristics.

Thus, when a corrugated metal band or an integrated metal band comprising a corrugated metal band and a smooth metal band is prepared, the metal band can be laminated or coiled to yield the honeycomb body having holes or apertures with regular openings and desired opening percentage.

Unless otherwise indicated, the numerical ranges involved in the invention include the end values.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A device for producing infrared radiation in a burner, the device comprising a honeycomb body, said honeycomb body comprising a plurality of metal bands;

wherein:

said plurality of metal bands is laminated or coiled to yield a plurality of holes or apertures;

said honeycomb body has a first surface and a second surface which are opposite to each other;

said holes or apertures penetrate through said first surface and said second surface;

an outer boundary of said first surface and an outer boundary of said second surface are connected to each other whereby yielding a lateral surface;

a through hole is disposed on said lateral surface of said honeycomb body and penetrates inward through multiple layers of adjacent metal bands;

a metal wire is disposed in said through hole;

said honeycomb body comprises a plurality of triangular plates; and said triangular plates sequentially overlap with one another and in combination with one another form an overlapped member.

2. The device of claim 1, wherein said holes or apertures are regular or irregular in shape, and a regular shape thereof comprises a sector, round, oval, semi-circle, triangle, or polygon.

3. The device of claim 1, wherein a central hole having a diameter of between 2 and 300 mm is disposed in a middle of said honeycomb body to operate as an air flow channel.

4. The device of claim 3, wherein said central hole, said lateral surface, or both are encircled by a metal frame.

5. The device of claim 1, wherein a groove formed by embedding said plurality of metal bands is filled with a metal material, and said metal material is fixed on said plurality of metal bands by welding or bonding.

6. The device of claim 1, wherein said overlapped member is formed and fixed by self-melting and welding of said plurality of metal bands, or fixed by bonding.

7. The device of claim 1, wherein said overlapped member is formed on said plurality of metal bands close to an inner or outer boundary of said honeycomb body.

8. The device of claim 1, wherein said overlapped member intersects with the whole of the plurality of metal bands of said honeycomb body.

9. The device of claim 1, wherein each of said plurality of metal bands comprises a corrugated metal band, or an integrated metal band comprising a corrugated metal band and a smooth metal band.

10. The device of claim 1, wherein each of said plurality of metal bands comprises an integrated metal band comprising two corrugated metal bands, and said holes or apertures are formed between said two corrugated metal bands.

11. The device of claim 1, wherein said first surface and/or said second surface of said honeycomb body is covered with at least one layer of metal mesh or metal fiber structure, said metal fiber structure is breathable and presents in the form of fiber mesh, fiber felt, woven mesh, or fiber paper, and a contact point between said honeycomb body and said metal mesh/said metal fiber structure is fixed by welding or bonding.

12. The device of claim 1, wherein a thickness between said first surface and said second surface is between 1 and 300 mm.

13. A method for manufacturing the device of claim 1, the method comprising the following steps:

a) preparing said plurality of metal bands;

b) laminating or coiling said plurality of metal bands to form said honeycomb body comprising the plurality of holes or apertures; and c) disposing said through hole on said lateral surface of said honeycomb body, allowing said through hole to penetrate inward through multiple layers of adjacent metal bands, and disposing said metal wire in said through hole; and/or, bending a part of each of said plurality of metal bands to form said triangular plate on each of said plurality of metal bands, and overlapping and engaging said triangular plate of each of said plurality of metal bands with said triangular plate of an adjacent metal band of said each of said plurality of metal bands to form said overlapped member.

14. The method of claim 13, further comprising covering said first surface and/or said second surface of said honeycomb body with at least one layer of metal mesh or metal fiber structure, and welding or bonding a contact point between said honeycomb body and said metal mesh/said metal fiber structure, wherein said metal fiber structure is breathable and presents in the form of fiber mesh, fiber felt, woven mesh, or fiber paper.

15. The method of claim 13, further comprising disposing a central hole having a diameter of between 2 and 300 mm in a middle of said honeycomb body to operate as an air flow channel.

16. The method of claim 15, further comprising disposing metal frames to encircle said central hole and said lateral surface.

17. The method of claim 13, further comprising filling a groove formed by embedding said plurality of metal bands with a metal material, and fixing said metal material on said plurality of metal bands by welding or bonding.

18. The method of claim 13, wherein step a) is achieved according to one of the following three steps:

1) preparing a corrugated metal band;

2) preparing an integrated metal band comprising a corrugated metal band and a smooth metal band; or 3) preparing an integrated metal band comprising two corrugated metal bands, said holes or apertures being formed between said two corrugated metal bands.

19. The method of claim 18, wherein said corrugated metal band prepared in step 1) is in the form of waveform including but not limited to sinusoidal waveform, sawtooth waveform, U-shaped waveform, or rectangular waveform.

20. The device of claim 1, wherein each of the plurality of triangular plates comprises a side and a tip opposite said side;

said side is connected to said metal band; and said tip of each of the plurality of triangular plates extends across said side of an adjacent triangular plate of the plurality of triangular plates and is connected to said adjacent triangular plate of the plurality of triangular plates.

* * * * *